United States Patent [19]

Okagami et al.

[11] 3,932,147

[45] Jan. 13, 1976

[54] METHOD OF REFORMING HYDROCARBONS

[75] Inventors: Akio Okagami, Fuchu; Akira Horie; Tsutomu Toida, both of Yokohama, all of Japan

[73] Assignee: Japan Gasoline Co., Ltd., Tokyo, Japan

[22] Filed: Sept. 9, 1974

[21] Appl. No.: 504,556

Related U.S. Application Data

[63] Continuation of Ser. No. 264,849, June 21, 1972, abandoned.

[30] Foreign Application Priority Data

June 28, 1971 Japan ..... 46-46377

[52] U.S. Cl. ..... 48/214; 48/196 R

[51] Int. Cl.[2] ..... C01B 2/14

[58] Field of Search..... 48/197 R, 213, 214, 196 R; 252/373; 260/676 R

[56] References Cited

UNITED STATES PATENTS

| | | | |
|---|---|---|---|
| 3,415,634 | 12/1968 | Dent et al. | 48/213 |
| 3,420,642 | 1/1969 | Percival | 48/214 |
| 3,866,353 | 2/1975 | Krumm et al. | 48/214 |

FOREIGN PATENTS OR APPLICATIONS

| | | | |
|---|---|---|---|
| 15,376 | 8/1967 | Japan | 252/373 |
| 1,265,481 | 3/1972 | United Kingdom | |
| 820,257 | 9/1959 | United Kingdom | 252/373 |

*Primary Examiner*—Robert L. Lindsay, Jr.
*Assistant Examiner*—Peter F. Kratz
*Attorney, Agent, or Firm*—Woodhams, Blanchard and Flynn

[57] ABSTRACT

The present invention relates to a method of manufacturing a gas rich in methane by subjecting two varieties or more of hydrocarbons having more than 2 carbon atoms per molecule and different mean molecular weights to steam-reforming process comprising at least two stages, wherein a mixture consisting of hydrocarbons whose means molecular weight is relatively small and steam is introduced to the nickel-containing catalyst bed for the first stage at a temperature in the range of 350° to 550°C, and subsequently, the resulting product is mixed with hydrocarbons whose mean molecular weight is larger than that of the preceding hydrocarbon — along with steam, if necessary — and is introduced to the nickel-containing catalyst bed at a temperature in the range of 300° to 550°C for the second stage.

7 Claims, 1 Drawing Figure

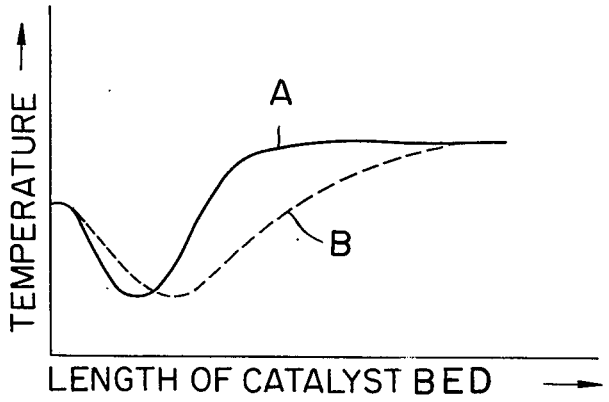
TEMPERATURE
A
B
LENGTH OF CATALYST BED

METHOD OF REFORMING HYDROCARBONS

This is a continuation of application Ser. No. 264 849, filed June 21, 1972, now abandoned.

BACKGROUND OF THE INVENTION a. Field of the Invention

The present invention relates to a method of steam-reforming of hydrocarbons, and it particularly relates to a method of manufacturing a methane-containing gas by steam-reforming of feeds of different kinds within one combined reaction system.

b. Description of the Prior Art

The method of manufacturing a methane-containing gas by steam-reforming of a mixture consisting mainly of such paraffin hydrocarbons as butane, light naphtha, etc. and steam at a temperature in the range of 400 to 500°C by the use of nickel-containing catalyst has heretofore been known (cf. British Pat. No. 820,257). In the case of steam-reforming of hydrocarbons having a large mean molecular weight, however, in view of the fact that the carbonaceous material is apt to be deposited onto the nickel-containing catalyst in use for the steam-reforming, rendering it difficult to maintain the life of the catalyst for a long time and hampering smooth operation of the apparatus, it has been usual to resort to employment of an excess of steam to minimize the deterioration of the activity of the catalyst. But the employment of an excess of steam not only is uneconomical from the viewpoint of the construction cost of the apparatus as well as the thermal requirements, but also it does not always bring about an ideal composition of the resulting gas as is evident from the fact that the steam-reforming reaction of hydrocarbons may be expressed by various chemical equilibrium formulas.

As a means of overcoming such troubles, there has been proposed a method comprising the steps of introducing a mixture of hydrocarbons into the reaction zones of two or more catalyst beds distributively while introducing the whole amount of the steam into the reaction column of the first stage, thereby augmenting the ratio of the steam to the mixture of hydrocarbons within the respective reaction zones (cf. the Japanese patent publication No. 22413/1969).

British Pat. No. 1,053,855 discloses the method of introducing hydrogen into the reaction system instead of the employment of an excess of steam as a means of maintaining the life of the catalyst for a long time. And, as to the source of hydrogen for this purpose, direct application of the gas arising from a high-temperature reformer and the like have been taught therein.

SUMMARY OF THE INVENTION

The present invention is to provide a method of manufacturing a methane-containing gas, which has further improved the afore-mentioned prior art and renders it possible to effect the steam reforming of even comparatively heavy hydrocarbons smoothly.

The present invention relates to a method of reforming hydrocarbons in at least two stages which is characterized by the steps: adiabatically effecting the steam reforming reaction of hydrocarbons having a relatively small mean molecular weight among those hydrocarbons having 2 or more carbon atoms per molecule, in the reaction zone of the first stage, after mixing with the hydrocarbons from 1.0 to 5.0 mols of steam per 1 carbon atom of said hydrocarbons, by contacting that mixture with a nickel-containing catalyst at a temperature in the range of 350 to 550°C; and subsequently, a diabatically effecting the steam reforming reaction of a mixture consisting of the reaction product gas coming out of the reaction zone of the first stage and other hydrocarbons having a relatively large mean molecular weight among the above-defined hydrocarbons — together with newly added steam, as occasion demands — at a temperature in the range of 300 to 550°C by the use of a nickel-containing catalyst.

BRIEF DESCRIPTION OF THE DRAWING

The appended drawing is a graph showing the relation between the temperature and the length of the catalyst bed as observed at the time of effecting the steam reforming of naphtha employed as the hydrocarbon starting material.

DETAILED DESCRIPTION OF THE INVENTION

The hydrocarbons having 2 or more carbon atoms per molecule to be treated by the method of the present invention include petroleum refinery gas, wet natural gas, liquefied petroleum gas, light naphtha, heavy naphtha, kerosene, etc. As to the relation between the hydrocarbons to be treated in the reaction zone of the first stage and the hydrocarbons to be treated in the reaction zone of the second stage, they are classified by their mean molecular weight: the mean molecular weight of the hydrocarbons to be subjected to treatment in the reaction zone of the second stage is to be larger than that of the hydrocarbons to be subjected to treatment in the reaction zone of the first stage, such as, for instance: butane is treated in the reaction zone of the first stage while naphtha is treated in the reaction zone of the second stage; light naphtha is treated in the reaction zone of the first stage while the heavy naphtha is treated in the reaction zone of the second stage; the light fraction obtained by fractionating a mixture of hydrocarbons into light fractions and heavy fractions is treated in the reaction zone of the first stage while the heavy fraction obtained as above is treated in the reaction zone of the second stage. That is, the hydrocarbons to be treated in the reaction zones of the first and second stages can be appropriately selected.

In the reaction zone of the first stage, to begin with, the low-temperature steam-reforming reaction of hydrocarbons having a comparatively small molecular weight or relatively small molecular weight is adiabatically effected under the condition that the molar ratio of steam to the feed hydrocarbons supplied is to be in the range of 1.0 to 5.0 moles per 1 carbon atom, the temperature at the inlet of the reaction zone be in the range of 350° to 550°C and the pressure be in the range of 0 to 100 Kg/cm$^2$G by the use of a nickel-containing catalyst. This nickel-containing catalyst can be a conventional catalyst for use in low-temperature steam-reforming reactions, including catalysts comprising a nickel component and additional components such as metals belonging to Group VIII, metals belonging to the left column of Group VII, metals belonging to the left column of Group VI, metals belonging to Group II or metals belonging to the right column of Group I of the Periodic Table and alkali metals, etc. as the active component or auxiliary component or catalysts comprising these components combined with any known promoter and/or carrier. The product gas coming out of the reaction zone of the first stage is a gas containing methane, hydrogen, carbon monoxide, carbon dioxide and unreacted steam.

According to the method of the present invention, the product gas coming out of the reaction zone of the first stage is subsequently subjected to the steam-reforming reaction in the reaction zone of the second stage upon mixing with newly added steam, if necessary, and another hydrocarbon whose mean molecular weight is larger than that of the hydrocarbon subjected to the treatment in the reaction zone of the first stage, at the inlet temperature in the range of 300° to 550°C and under the pressure optionally chosen - preferably in the range of 0 to 100 Kg/cm$^2$G — in the presence of a nickel-containing catalyst. As the nickel-containing catalyst to be employed on this occasion, the same as that employed in the reaction zone of the first stage will do.

Although the steam-reforming reaction in the reaction zone of the second stage is effected on comparatively heavy hydrocarbons, inasmuch as this steam-reforming reaction is performed in the presence of the product gas coming out of the reaction zone of the first stage which contains methane, hydrogen, carbon dioxide, etc., the life of the catalyst is long, accomplishing a smooth reaction in spite of the lowered ratio of steam applied as compared with the conventional steam-reforming of hydrocarbons. In this connection, the quantitative ratio of the hydrocarbons to be treated in the reaction zone of the first stage to the hydrocarbons to be treated in the reaction zone of the second stage may be determined appropriately.

Therefore, according to the method of the present invention, even such feeds as heavy naphtha, kerosene, etc., whose employment for the purpose of obtaining a methane-containing gas through gasification reaction thereof has heretofore been considered unprofitable from the economic point of view, can be effectively treated as a result of combination of these feeds with a hydrocarbon having mean molecular weight smaller than theirs. Besides, on the occasion of steam-reforming reaction of hydrocarbons, a sharp decrease of the added steam entails as increase of methane contained in the resulting gas. Accordingly, the product gas to be obtained by the method of the present invention is best suited for use as a city gas or fuel gas.

Further, the present invention is characterized by the fact that the hydrogen-containing gas which serves for decreasing the excess steam employed in order to maintain for a long time the life of the catalyst for effecting the steam-reforming reaction, is the hydrogen-containing gas produced within the same reaction system. Moreover on the occasion of steam-reforming of comparatively heavy hydrocarbons, the hydrogen-containing gas resulting from the low-temperature steam-reforming reaction of comparatively light hydrocarbons is used instead of the hydrogen-containing gas produced by a high-temperature reformer such as disclosed in the aforesaid British Pat. No. 1,053,085. The effect of the employment of the product gas arising from the low-temperature steam-reforming reaction will be clearly understood from comparison of the examples embodying the method of the present invention and the comparative example as shown in the following.

According to the method of the present invention, it is of course possible to interlink a plurality of reaction zones, such as the first one, second one, third one and so on, to perform the foregoing treatment by stepping up the mean molecular weight of hydrocarbons to be treated in the respective reaction zones in order, thereby manufacturing said methane-containing gas.

DESCRIPTION OF THE PREFERRED EMBODIMENTS

Hereunder will be given examples embodying the present invention.

EXAMPLE 1

In this example, a variety of tests as follows were conducted for the sake of comparison. As the feed hydrocarbons, naphtha having 7.0 carbon atoms on the average per 1 molecule, IBP of 40°C, FBP of 185°C and specific gravity ($d_4^{15}$) of 0.7 and butane were employed.

Test 1

When the feed naphtha mixed with steam at the rate of 2.0 moles of steam per 1 carbon atom of naphtha was fed to an adiabatic reactor packed with a nickel-containing catalyst employing kieselguhr as the carrier at the mass velocity of 20,000 Kg/m$^2$hr and the inlet temperature of 500°C and held under the pressure of 33 Kg/cm$^2$G, the outlet temperature became 530°C. On this occasion, the distribution of temperature in the catalyst bed of the adiabatic reactor changed with the lapse of time assigned for the test as shown in the appended drawing (the solid line A shows the state of distribution after $\theta$ hours from start of test and dotted line B shows the state of distribution $\theta + \Delta\theta$ hours after the start of test.). This indicates the fact that the activity of catalyst is gradually deteriorated which causes the requirement of still more catalyst to complete the reaction and to attain an equilibrium. It is possible to figure out the amount of catalyst being required for completion of the reaction on this occasion through measurement of the distribution of temperature. Therefore, by applying this method, the amount of catalyst being required for completion of the reaction after 500 hours from the start of test was estimated. Further, the composition of the product gas on this occasion was also analyzed.

Test 2

When the feed butane mixed with steam at the rate of 5.0 moles of steam per 1 carbon atom of butane was fed to an adiabatic reactor of the first reaction stage packed with the same nickel-containing catalyst as that in Test 1 above at the mass velocity of 20,000 Kg/m$^2$hr and the inlet temperature of 544°C and held under the pressure of 33 Kg/cm$^2$G, the outlet temperature became 500°C.

Next, when the gas arising from this first reaction stage containing steam was mixed with the feed naphtha and newly added steam at the rate of 1.5 mols of the total steam per 1 carbon atom of naphtha and fed to an adiabatic reactor of the second reaction stage packed with the same nickel-containing catalyst as above at the mass velocity of 20,000 Kg/m$^2$hr and the inlet temperature of 435°C to be held under the pressure of 33 Kg/cm$^2$G, the outlet temperature became 530°C. In the same way as in Test 1, the amount of catalyst being required for completion of the reaction after 500 hours from the start of the test and the composition of the product gas were measured. In this connection, the weight ratio of butane to be treated in the first reaction stage to naphtha to be treated in the second reaction stage was 1.0:3.43.

Test 3

When the feed hydrocarbon composed of butane and naphtha at the weight ratio of 1:3.43 was mixed with steam at the rate of 1.8 moles of steam per 1 carbon atom of said feed hydrocarbon and fed to an adiabatic reactor packed with the same nickel-containing catalyst as that in Test 1 above at the mass velocity of 20,000 Kg/m²hr and the inlet temperature of 495°C to be held under the pressure of 33 Kg/cm²G, the outlet temperature became 530°C. In the same way as in Test 1, the amount of catalyst being required for completion of the reaction after 500 hours from the start of test and the composition of the product gas were measured.

Test 4

The feed butane mixed with steam at the rate of 5.0 mols of steam per 1 carbon atom of butane was fed to an adiabatic reactor of the first reaction stage packed with a nickel-containing catalyst for use in high-temperature reforming at the temperature of 400°C and held under the pressure of 33 Kg/cm²G, whereby the outlet temperature of 800°C was attained.

When the product gas together with unreacted steam coming out of this first reaction stage was mixed with the feed naphtha and newly added steam at the rate of 1.5 mols of the total steam per 1 carbon atom of naphtha and fed to an adiabatic reactor of the second reaction stage packed with the same nickel-containing catalyst as that in Test 1 at the inlet temperature of 435°C, the outlet temperature became 625°C.

On this occasion, the weight ratio of butane to naphtha was made to be 1:3.43.

TEST 5.

Except for making the weight ratio of butane to naphtha to be 1.0:15.7, the same treatment as in Test 4 was performed. As a result, the temperature at the outlet of the adiabatic reactor of the second reaction stage became 537°C.

As seen in this Table, inasmuch as Tests 4 and 5 above were conducted by employing a high-temperature steam-reforming apparatus requiring comparatively expensive equipment in the first stage of the reaction, it is impossible to compare directly the results of measurement of the amount of catalyst required for completion of reaction after 500 hours from the start of test, but the concentration of methane in the product gas is obviously lower than that in Test 2 corresponding to the embodiment of the present invention.

And this Result of Test verifies that the product gas obtained in Test 2 is high in concentration of methane and best suited for fuel gas.

In the case of Test 4 wherein the weight ratio of butane to naphtha was 1:3.43, because of the presence of plenty of hydrogen in the reaction system, there concurrently took place a hydrogenating decomposition reaction and a rise in the temperature of the catalyst at the time of the steam-reforming reaction, rendering long retention of the activity of catalyst difficult.

The retention of the activity of catalyst has heretofore required to raising of the molar ratio of steam to the feed hydrocarbons. But, this Result of Test proves that, if the amount of catalyst necessary for completion of the reaction after 500 hours from the start thereof is equal, the molar ratio of steam to the feed hydrocarbon is minimized by the method employed in Test 2.

EXAMPLE 2

By making a light fraction of hydrocarbon having A.P.I. Gravity of 78.85° and a boiling point range of 37° to 119°C mixed with steam at the rate of 4 mols of steam to 1 carbon atom pass through a nickel-containing catalyst employing kieselguhr as the carrier at the inlet temperature of 517°C for the first reaction stage and the feed rate of 0.1580 l/hr under the pressure of 33 Kg/cm²G, a steam-reforming reaction was performed. As a result, the outlet temperature of the first reaction stage was 500°C, and the composition of the Result of Test

| Test | | 1 | 2 | | 3 | 4 | | 5 | |
|---|---|---|---|---|---|---|---|---|---|
| number of stage | | 1 | 1 | 2 | 1 | 1 | 2 | 1 | 2 |
| wt. ratio of hydrocarbon to be treated | | | | 3.43 | | | 3.43 | | 15.7 |
| temperature (°C) | | 500~530 | 544~500 | 435~530 | 495~530 | 400~800 | 435~625 | 400~800 | 435~537 |
| Composition of product gas (vol.%) | $CH_4$ | 26.1 | 11.6 | 37.2 | 28.7 | 2.0 | 29.4 | 2.0 | 29.8 |
| | $H_2$ | 9.9 | 8.7 | 9.0 | 9.9 | 33.8 | 17.7 | 33.8 | 10.2 |
| | CO | 0.5 | 0.1 | 0.8 | 0.5 | 4.8 | 2.6 | 4.8 | 0.7 |
| | $CO_2$ | 10.8 | 5.3 | 13.0 | 11.0 | 7.6 | 12.3 | 7.6 | 11.7 |
| | $H_2O$ | 52.7 | 74.3 | 40.0 | 49.9 | 51.9 | 38.0 | 51.8 | 47.6 |
| | total | 100.0 | 100.0 | 100.0 | 100.0 | 100.0 | 100.0 | 100.0 | 100.0 |
| amount of catalyst being required for completion of reaction 500 hrs after the start of test | at each stage | 0.72 | 0.24 | 0.48 | 0.86 | | 0.92 | | 0.48 |
| | total | 0.91* | 0.72 | | 0.86 | | | | |

*To equalize the quantity of hydrocarbons employed, 1.9 Kg of catalyst necessary for the treatment of butane was added (when the molar ratio of steam per 1 carbon atom of butane was 1.5).

gas coming out of the first reaction stage was as follows:

| | |
|---|---|
| $CH_4$ | 14.25 % (Vol) |
| $H_2$ | 8.49 |
| CO | 0.16 |
| $CO_2$ | 6.53 |
| $H_2O$ | 70.57 |

Subsequently, by making a heavy fraction of hydrocarbon having A.P.I. Gravity of 47.60° and a boiling point range of 143° to 238°C and mixed with the foregoing product gas as well as unreacted steam at the rate of 2 mols of the total steam including the steam coming out of the first reaction stage plus newly added steam per 1 carbon atom of said heavy fraction of hydrocarbon pass through a nickel-containing catalyst employing kieselguhr as the carrier at the inlet temperature of 469°C for the second reaction stage and the feed rate of 0.60 l/hr under the pressure of 33 Kg/cm²G, a steam-reforming reaction was performed. As a result, the outlet temperature of the second reaction stage was 540°C, and the composition of the gas coming out of the second reaction stage was as follows:

| | |
|---|---|
| $CH_4$ | 28.68 % (vol) |
| $H_2$ | 10.15 |
| CO | 0.73 |
| $CO_2$ | 12.68 |
| $H_2O$ | 47.76 |

As the result of measurement of the temperature distribution in the catalyst bed, the amount of catalyst required for completion of reaction after 50 hours, after 100 hours and after 150 hours from the start of reaction was 0.530 Kg, 0.588 Kg and 0.600 Kg, respectively.

COMPARATIVE EXAMPLE

When the same feed mixture containing hydrocarbons having A.P.I. Gravity of 47.60° and the boiling point range of 143° to 238°C as that employed in Example 2 above was mixed with steam at the rate of 2 mols per 1 carbon atom of said feed hydrocarbons and treated with a nickel-containing catalyst employing kieselguhr as the carrier at the first reaction stage by applying the inlet temperature of 484°C, the pressure of 33 Kg/cm²G and the charging feed of 0.6 l/hr, the composition of the resulting gas was as follows:

| | |
|---|---|
| $CH_4$ | 25.41 % (vol) |
| $H_2$ | 10.35 |
| CO | 0.66 |
| $CO_2$ | 12.10 |
| $H_2O$ | 51.48 |

However, after 10 hours from the start of reaction, the catalyst showed a remarkable deterioration, the pressure drop of the reaction column was increased and the test would not be continued. When the catalyst was taken out and examined after the test, there was observed a carbonaceous material deposited onto the catalyst.

EXAMPLE 3

The feed hydrocarbons having IBP of 45°C and FBP of 243°C were distilled to obtain a light fraction having IBP of 37°C and FBP of 152°C and a heavy fraction having IBP of 144°C and FBP of 249°C.

The thus obtained light hydrocarbon fraction was mixed with steam in the ratio of 4 mols of steam to 1 carbon atom of hydrocarbon, and then the mixture was fed into an adiabatic reactor packed with a catalyst in a quantity as shown below, for reaction therein at the inlet temperature of 515°C and under the inside pressure of 33 Kg/cm²G. During said reaction, the hydrocarbon was supplied at the rate of 0.155 l/hr and the outlet temperature was measured as 500°C.

Subsequently, the thus produced gas was mixed with a heavy fraction of hydrocarbon in the ratio of 2 mols of steam, including unreacted steam arising from the first reactor as well as additional steam, to 1 carbon atom of hydrocarbon, so that a further reaction was carried out within the second reactor by feeding said mixture therein at the inlet temperature of 465°C, under the pressure of 33 Kg/cm²G and with the supply of the heavy fraction at the rate of 0.61 l/hr.

The outlet temperature of the second reactor was measured as 540°C and the gas composition was observed as below.

| | |
|---|---|
| $CH_4$ | 28.78 Vol% |
| $H_2$ | 10.12 " |
| CO | 0.71 " |
| $CO_2$ | 12.65 " |
| $H_2O$ | 47.74 " |

In addition, it should be noted that the first and second reactors were packed with a nickel-containing catalyst, employing kieselguhr as a carrier, in the quantity of 0.6 Kg and 0.8 Kg respectively, and it was after 540 hrs from the outset of reaction that the unreacted hydrocarbon was observed being blown out therefrom.

COMPARATIVE EXAMPLE

Without fraction distillation the feed hydrocarbons (having IBP of 45°C and FBP of 243°C), which had been used in Example 3, was brought into contact with a nickel-containing catalyst bed together with steam at the rate of 2 mols of $H_2O$ to 1 carbon atom of hydrocarbon. The nickel-containing catalyst was just the same was used in Example 3.

On this occasion the inlet temperature of the reactor was kept at 487°C while the pressure therein was 33 Kg/cm²G; however the reaction was stopped after the elapse of 15 hrs from the start, since a gradual increase of the pressure drop was observed in the catalyst bed, whereby an immense deterioration of activity thereof was expected, as apparent from the graph illustrating the temperature distribution in the catalyst bed.

When the catalyst bed was taken out for examination after the test, there was observed the deposition of carbonaceous material upon the catalyst.

EXAMPLE 4

0.5 liter of the feed butane mixed with 0.72 Kg/hr of steam in the ratio of 1 mol of butane to 2 mols of steam was fed into the first reactor packed with a nickel-containing catalyst employing kieselguhr as the carrier at the inlet temperature of 487°C, while the pressure in said reactor was kept at 25.9 Kg/cm²G, thus inducing the outlet temperature of 500°C.

The gas arising from the first reaction stage was mixed with naphtha (having IBP of 40°C, FBP of 175°C and specific gravity 56°C) at the rate of 0.37 l/hr, in order that the mixture was subsequently fed into the second reactor which was packed with a nickel-containing catalyst just like the first reactor was at the inlet temperature of 489°C. When the pressure in said reactor was kept constantly at 25.9 Kg/cm²G, the outlet temperature thereof rose to 530°C. The following is the composition of the product gas on this occasion:

| | |
|---|---|
| $CH_4$ | 64.2 % (Vol) |
| $H_2$ | 12.1 % |
| CO | 1.6 % |
| $CO_2$ | 22.1 % |

In addition, the first and second reactors were packed with catalyst in the quantity of 0.4 Kg and 0.5 Kg, respectively. Even after an operation of 600 hrs of the reactor, no unreacted naphtha was blown out therefrom.

COMPARATIVE EXAMPLE

A mixture of 0.5 l/hr of butane and 0.37 l/hr of naphtha was mixed with 0.72 Kg/hr of steam at the rate of 0.99 for steam to mixture, so as to be fed into an adiabatic reactor packed with a nickel-containing catalyst just the same as was employed in Example 4.

However, the test was stopped of necessity after it was started, since a continuous increase of the pressure drop in the catalyst bed was observed. When the catalyst was taken out therefrom after the test, the deposition of carbonaceous material was found upon the catalyst.

What is claimed is:

1. A process for preparing gas rich in methane by reforming hydrocarbon having an average of two or more carbon atoms per molecule, in at least two stages, which comprises;

feeding into a first reforming zone a first reactant gas consisting essentially of a mixture of steam and first hydrocarbon having a low mean molecular weight with said reactant gas containing from 1.0 to 5.0 mols of steam per one carbon atom of said first hydrocarbon, and adiabatically effecting a first reforming reaction in said first reforming zone by contacting said reactant gas, at a pressure of 0 to 100 kg/cm² gauge, with a first bed of nickel-containing reforming catalyst, effective to maintain the gas in the first reforming zone at a temperature of 350° to 550°C, to produce a first reaction product gas consisting essentially of methane, hydrogen, carbon monoxide, carbon dioxide and steam, feeding into a second reforming zone a second reactant gas comprising a mixture of said reaction product gas from said first zone and second hydrocarbon having a mean molecular weight higher than that of said first hydrocarbon wherein the ratio of steam per 1 carbon atom of said hydrocarbon in said second reactant gas is lower than the corresponding ratio in said first reactant gas, and adiabatically effecting a second reforming reaction by contacting said second reactant gas, at a pressure of 0 to 100 Kg/cm² gauge, with a second bed of nickel-containing reforming catalyst, effective to maintain the gas in said second reforming zone at a temperature of 300° to 550°C to produce a second reaction product gas which is rich in methane, the difference between the mean molecular weight of said first and second hydrocarbon and the relative amount of said first and second hydrocarbon fed to the first and second zones respectively being sufficient to substantially prolong the life of the reforming catalyst as compared to the use of a mixture of the first and second hydrocarbon as a feed for both the first and second reforming zones.

2. A process according to claim 1, wherein said hydrocarbons having an average of two or more carbon atoms per molecule are selected from the group consisting of petroleum refinery gas, liquefied petroleum gas, light naphtha, heavy naphtha and kerosene.

3. A method according to claim 1, wherein the number of the reaction zones is two.

4. A method according to claim 1, wherein said hydrocarbons having low mean molecular weight and hydrocarbons having higher mean molecular weight are obtained by fractionating hydrocarbons having an average of two or more carbon atoms per molecule, recovering separately two fractions having lower and higher boiling point range respectively, utilizing said fraction having a lower boiling point range as said first hydrocarbon and utilizing said fraction having a higher boiling point range as said second hydrocarbon.

5. A process according to claim 1, in which said second reactant gas consists essentially of a mixture of said reaction product gas from said first zone, said second hydrocarbon and an additional quantity of steam fed directly into said second reforming zone.

6. A process according to claim 1, in which said second reactant gas consists essentially of a mixture of said reactant product gas from said first zone and said second hydrocarbon.

7. A process according to claim 1 wherein the temperature of the first reaction product gas at the outlet end of said first reforming zone is lower than the temperature of the reactant gas fed into the inlet end of said first reaction zone, and the temperature of the second reaction product gas at the outlet end of said first reaction zone is higher than the temperature of the second reactant gas fed into the inlet end of said further reaction zone and is higher than the temperature of the first reaction product gas at the outlet end of said first reforming zone.

* * * * *

UNITED STATES PATENT OFFICE

CERTIFICATE OF CORRECTION

Patent No. 3 932 147 Dated January 13, 1976

Inventor(s) Akio Okagami, Akira Horie and Tsutomu Toida

It is certified that error appears in the above-identified patent and that said Letters Patent are hereby corrected as shown below:

Col. 9, line 53; change "said hydrocarbon" to ---said second hydrocarbon---.

Col. 10, line 31; change "range" to ---ranges---.

Col. 10, line 50; change "first" to ---further---.

Signed and Sealed this

Sixth Day of July 1976

[SEAL]

*Attest:*

RUTH C. MASON
*Attesting Officer*

C. MARSHALL DANN
*Commissioner of Patents and Trademarks*